US007126478B2

(12) United States Patent
Rapp et al.

(10) Patent No.: US 7,126,478 B2
(45) Date of Patent: Oct. 24, 2006

(54) METHOD AND DEVICE FOR THE ACTIVATION OF LARGE QUANTITIES OF SECURITY ELEMENTS FOR THE ELECTRONIC ARTICLE PROTECTION

(75) Inventors: Michael Rapp, Modautal (DE); Pierre Doyelle, Montmelian (FR)

(73) Assignee: Meto International GmbH, Hirschhorn (DE)

( * ) Notice: Subject to any disclaimer, the term of this patent is extended or adjusted under 35 U.S.C. 154(b) by 0 days.

(21) Appl. No.: 11/212,279

(22) Filed: Aug. 26, 2005

(65) Prior Publication Data

US 2005/0280541 A1 Dec. 22, 2005

Related U.S. Application Data

(60) Division of application No. 10/115,656, filed on Apr. 4, 2002, now Pat. No. 6,965,316, which is a continuation of application No. PCT/EP00/09456, filed on Sep. 27, 2000, now abandoned.

(30) Foreign Application Priority Data

Oct. 4, 1999 (DE) ..... 199 47 695

(51) Int. Cl.
*G08B 13/14* (2006.01)

(52) U.S. Cl. ..... 340/571; 340/572.1; 340/573.3; 340/551; 340/568.1; 340/676

(58) Field of Classification Search ..... 340/571, 340/572.1, 572.3, 572.4, 572.7, 568.1, 676, 340/551, 825.49, 825.69
See application file for complete search history.

(56) References Cited

U.S. PATENT DOCUMENTS

| | | | | |
|---|---|---|---|---|
| 5,126,720 | A | 6/1992 | Zhou et al. | |
| 5,327,118 | A | 7/1994 | Drucker et al. | |
| 5,500,640 | A | 3/1996 | Zhou et al. | |
| 5,907,465 | A | 5/1999 | Easter | |
| 5,973,606 | A | 10/1999 | Maitin et al. | |
| 6,114,961 | A | 9/2000 | Denholm et al. | |
| 6,154,135 | A | 11/2000 | Kane et al. | |
| 6,169,481 | B1 * | 1/2001 | Goldberg et al. | 340/572.1 |
| 6,452,504 | B1 * | 9/2002 | Seal | 340/825.49 |

FOREIGN PATENT DOCUMENTS

| | | |
|---|---|---|
| EP | 0 123 586 | 6/1988 |
| EP | 0 495 486 | 11/1992 |
| EP | 0 295 028 | 4/1993 |
| WO | WO 95/08177 | 3/1995 |

* cited by examiner

*Primary Examiner*—Hung Nguyen
(74) *Attorney, Agent, or Firm*—Caesar, Rivise, Bernstein, Cohen & Pokotilow, Ltd.

(57) ABSTRACT

A method and device for activation of large quantities of security elements for the electronic article protection. The security elements are exposed to at lease one magnetic field produced by one or more coils carrying a line current subjected to sine oscillations. The coils are supplied with current pulses that are shorter than the sine oscillations. The amplitude of the current pulses diminishes as a function of time.

3 Claims, 4 Drawing Sheets

METHOD AND DEVICE FOR THE ACTIVATION OF LARGE QUANTITIES OF SECURITY ELEMENTS FOR THE ELECTRONIC ARTICLE PROTECTION

CROSS-REFERENCE TO RELATED APPLICATIONS

This application is a divisional application of, and claims the benefit under 35 U.S.C. §121 of, application Ser. No. 10/115,656, filed on Apr. 4, 2002, now U.S. Pat. No. 6,965,316 entitled METHOD AND DEVICE FOR THE ACTIVATION OF LARGE QUANTITIES OF SECURITY ELEMENTS FOR THE ELECTRONIC ARTICLE PROTECTION, which in turn is a continuation application of PCT/EP00/09456 filed on Sep. 27, 2000, now abandoned which takes its priority from German Patent Application No. 199 47 695.0 filed on Oct. 4, 1999 and all of whose entire disclosures are incorporated by reference herein.

BACKGROUND OF THE INVENTION

This invention refers to a method of activating large quantities of security elements to electronically protect articles, to a large-scale activator for the activation of such security elements, and to the security elements themselves.

In this connection it should be mentioned that the individual security elements have a magnetic material with high permeability and low coercive force (magnetically soft material) and a magnetic material with low permeability and high coercive force (magnetically semi-hard or hard material). The magnetically soft material is ordinarily excited by application of an alternating magnetic field in a query zone for remission of a characteristic signal. This characteristic signal can be suppressed if the magnetically semi-hard or material is in a remanent magnetization state after a corresponding high magnetic field has been applied.

Security elements of the type described above are preferably used in the field of electronic article protection in department stores and ware houses. A particularly advantageous embodiment of a security element has been published in EP 0 295 028 B1. So-called thin-film security elements are described in this patent specification. These elements are comprised of a thin layer—preferably in the μm range—of magnetically soft material. The layer is applied to a carrier substrate, for example by means of a physical deposition process under vacuum conditions.

Thin-film security elements have an anisotropic structure. Anisotropic means that the magnetically soft layer of which the thin-film security elements are made has a preferred axis. In practice, the anisotropic structure reveals itself in that the characteristic signal remitted by the thin-film security element in response to a query field is at a maximum when the query field and the preferred axis are parallel to one another; on the other hand, the signal disappears when the preferred axis and the query field are perpendicular to one another.

Analogous behavior is also displayed by the so-called strip elements comprised of a strip of magnetically soft material. Here, too, the characteristic signal is at a maximum when the query field and the strips are parallel to one another, and it disappears when they are perpendicular. Moreover, the strip element can also be comprised of a drawn wire.

A plurality of different methods for the detection of security elements in the query zone have been publicized. The detection apparatus proposed in EP 123 586 B is one example.

For the deactivation of a thin-film security element following proper payment for the protected article, a punched foil—for instance of a magnetically hard material such as nickel—is provided on the magnetically soft material. In the case of strip elements, segments of a magnetically semi-hard or hard material are arranged in close proximity to the magnetically soft strip or even directly on the strips themselves.

In both cases, the remagnetized deactivation material generates a stray field that pre-magnetizes the magnetically soft material in such a manner that it is no longer detected in the query zone. To achieve a reliable deactivation it is necessary for the deactivation material to be converted to a defined magnetized state (remanence) that ensures maximum magnetization and therefore a maximum stray field.

At present, the security elements mentioned repeatedly above are generally supplied to the user in an activated state.

However, since only a portion of industry and retail businesses have systems for the detection and deactivation of the electromagnetic security elements described here, the manufacturers and distributors of such security elements are becoming increasingly interested in shipping the security elements in the deactivated state, i.e. with remanent magnetically hard deactivation material. Interest in such a procedure has grown since the Institut für Distributions- und Handelslogistik (Institute of Distribution and Trade Logisitics) in D-44227 Dortmund has been advocating the deactivation of such security elements with one hundred percent certainty, while a ninety-eight percent success rate is considered adequate for the activation of the security elements. These requirements have meanwhile also been set forth in the VDI (Association of German Engineers) Guideline 4471, sheet 1.

Due to the state of affairs described above, it appears to be advantageous to carry out the activation in central distribution sites in which it is known which purchasers require activated or deactivated security elements. In this connection it would be advantageous to be able to activate entire palettes of security elements at a time.

The activation of such large quantities of security elements is not possible with today's state of the art. Therefore, up to now, this procedure has been too costly. At present it is only possible to activate small quantities of security elements, for example in a tunnel demagnetization device for demagnetizing workpieces. These tunnel demagnetization devices generally have a coil which generates an alternating magnetic field for demagnetization of the workpieces. The amplitude of this alternating field diminishes during the demagnetizing process, so that the workpiece is successively demagnetized. However, due to the strong dependence of the action of the magnetic field on the distance between workpiece and coil, the dimensions of the tunnel in which the workpieces are demagnetized are severely limited. For example, the company Bakker Magnetics b.v., Sciencepark Eindhoven 5502 in 5692 EL Son, the Netherlands, offers such a device under article number BM 70.200. This device has a demagnetizing tunnel measuring 220 (length)×150 (width)×60 (height) $mm^3$. To produce a magnetic flux within this tunnel which is adequate to reliably demagnetize the workpieces, the device requires an electric power of 1050 watts. If the device is operated with 220 v alternating current, a maximum effective current of approximately 5 A therefore results. In the case of extended periods of operation this very quickly leads to coil overheating and hinders prolonged running of the device.

Moreover, the demagnetization of the security elements in such a tunnel demagnetization device is often not reliable enough. One reason for this drawback, for example, is that even a small angle between the magnetic field of the demagnetization device and the security element or elements to be activated prevents complete demagnetization of their magnetically hard components, so that the security elements in question remain in the deactivated state.

BRIEF SUMMARY OF THE INVENTION

The object of the present invention is to propose a method and an apparatus by means of which the activation of a large number of security elements is possible.

A method is proposed in which only magnetic pulses that are very much shorter than the sine oscillations to which current and voltage are subjected in power networks, are used for the activation of the security elements. In this manner, the effective current required to produce the necessary magnetic flux is greatly reduced, which permits the generation of a magnetic field that allows activation of the security elements even across a greater distance. An additional positive effect is the limited heating up of the coil. This allows for continuous operation of the apparatus, if applicable. To activate the security elements it is necessary for the amplitudes of the individual pulses to diminish (fade) as a function of time.

In another advantageous embodiment of the invention a further reduction of the required current is achieved if the polarity of the current is not reversed at every current pulse, but rather only after a certain number of these pulses. The successive pulses up to the next polarity change are referred to below as a pulse group.

In providing the required current it can be useful for the positive current pulses to originate from positive half-waves of the line current, while the negative current pulses are taken from negative half-waves. In this case it can happen that if there is a very rapid succession of current pulses an entire pulse group will originate from one half-wave, or if there is a large interval between current pulses, only one current pulse is taken from one half-wave.

As mentioned above, it is necessary for the amplitude of the current pulses to diminish as a function of time. For this it has proven to be especially advantageous for the reduction of the amplitude to be elliptical or linear.

To increase the efficiency of the large-scale activator it is advantageous to equip it with one or more coil systems which provide magnetic fields with different directions. In this way it is possible to avoid having the magnetically hard components of the security elements contain a residual magnetization which would impair or completely prevent the activation of the security elements. In this connection it is advantageous to select at least two directions perpendicular to one another.

An advantageous embodiment of the large-scale activator therefore has one or more coil systems which is or are suitable for generating three magnetic fields orthogonal to each other in the area of the activation zone. In this way, for example, the three dimensions of the Cartesian coordinate system can be covered.

In the embodiment of the activation method described above, it is particularly advantageous if the magnetic fields with different directions act in succession on the security elements. Unintended interactions in the activation zone, such as interference phenomena between the magnetic fields, can be avoided in this manner.

A current that is pulsed in the manner described above can be provided by the means available in modern power electronics. For instance, nowadays it is possible to construct circuits using power thyristors, integrated gate transistors and free-wheeling diodes, as well as other power semiconductors, relays or high-frequency switches, which modulate or convert the line current in the necessary manner.

Furthermore, a portion of the frequency inverters or servo-actuators used in electronic drive engineering is capable of generating suitable pulses. Since these products are standard devices they are relatively inexpensive.

As already mentioned, in the large-scale activator according to the invention it is advantageous if the coils arranged in the device define an activation zone in which magnetic fields perpendicular to each other can occur.

The generation of these magnetic fields can be performed by coils arranged perpendicular to each other. Since the reliability with which the security elements are activated increases with the number of different directions of the magnetic field, it is advantageous to provide at least two coils in perpendicular arrangement relative to one another in the large-scale activator. Due to the large spatial extent of the activation zone, at least two or more coils per direction are generally provided. These arrangements of coils, referred to in the following as coil systems, can be connected in series or parallel. Of course, with the means provided by modern-day electronics, in especially powerful devices it is also possible to trigger different coils of a coil system with the same or similar current pulses, without the coils being directly interconnected electrically.

A further advantageous embodiment of the large-scale activator has three coils or coil systems which are directed perpendicularly to each other and which generate magnetic fields in three different spatial dimensions. These three dimensions can form a Cartesian coordinate system, for example.

To make a rapid activation of numerous security elements possible, an advantageous embodiment of the invention has an activation zone that is located in a relatively spacious passage, which can, for example, be designed as a tunnel.

In this connection it is especially advantageous if the security elements to be activated can remain on a suitable carrier or transport system, such as those used in modern commerce, while the activation is taking place.

Therefore, rollers can be mounted on the base (floor) of the passageway, and the palettes loaded with security elements can be pushed through the passageway on said rollers.

Of course, a conveyor belt can also be provided to pass through such a passageway. For example, cases or rolls of security elements can be moved at elevated speeds on this conveyor belt.

Naturally, similar possibilities are also offered by rail transport systems commonly used today in the distribution and storage of goods.

Security elements that are still arranged in strips one after the other or adjacent to each other can also be passed through a relatively compact activator.

It would even be possible to pass several strips simultaneously through the large-scale activator.

Any other transport systems used in commerce can also be combined with the large-scale activator. Of course, such a large-scale activator can also be designed in such a manner that larger quantities of security strips at a time can be activated with simpler transport systems such as a lift truck. Especially in such a discontinuous loading of the activator it is of course possible to feed and remove the security elements at the same side of the activator. This would eliminate the necessity of providing the activation zone—for example—in a passageway. Furthermore, if the activator is loaded by means of a lift truck, it is helpful if the base (floor) of the activation zone of the large-scale activator is at ground level.

When these modern transport or goods management systems are used, it is advantageous for the large-scale activator to be equipped with an automatic switching device that recognizes whether the security elements being transported in or on the given palettes, cases, rollers, belts, etc., are to be activated or not. Magnetic resonant circuits, for example, which can be provided on the aforementioned transport containers, are suitable for this purpose. They in turn emit characteristic electromagnetic radiation when they are located in a suitable electromagnetic field. The large-scale activator would then have to be provided with a transmitting and receiving device tuned to the resonant circuits.

Of course, such as large-scale activator can also include the possibility of deactivation of larger quantities of security elements. For this purpose, the apparatus would have to be run in such a manner that the amplitude of the magnetic field or of the magnetic field pulses does not diminish (fade) as a function of time and no change in polarity (sign) occurs at high frequency.

As mentioned at the beginning of the description, the security elements activated according to the method of the invention or by an apparatus according to the invention offer great advantages in their shipping and employment. In this connection, it is merely repeated as a reminder that the deactivation of security elements for electronic protection of articles has to be done with 100 percent certainty in accordance with the VDI guideline no. 4471. This is highly problematic in the case of a general activation of the security elements during or directly following the manufacturing process. In contrast to this, the activation of previously deactivated security elements can be carried out with only a ninety-eight percent certainty.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
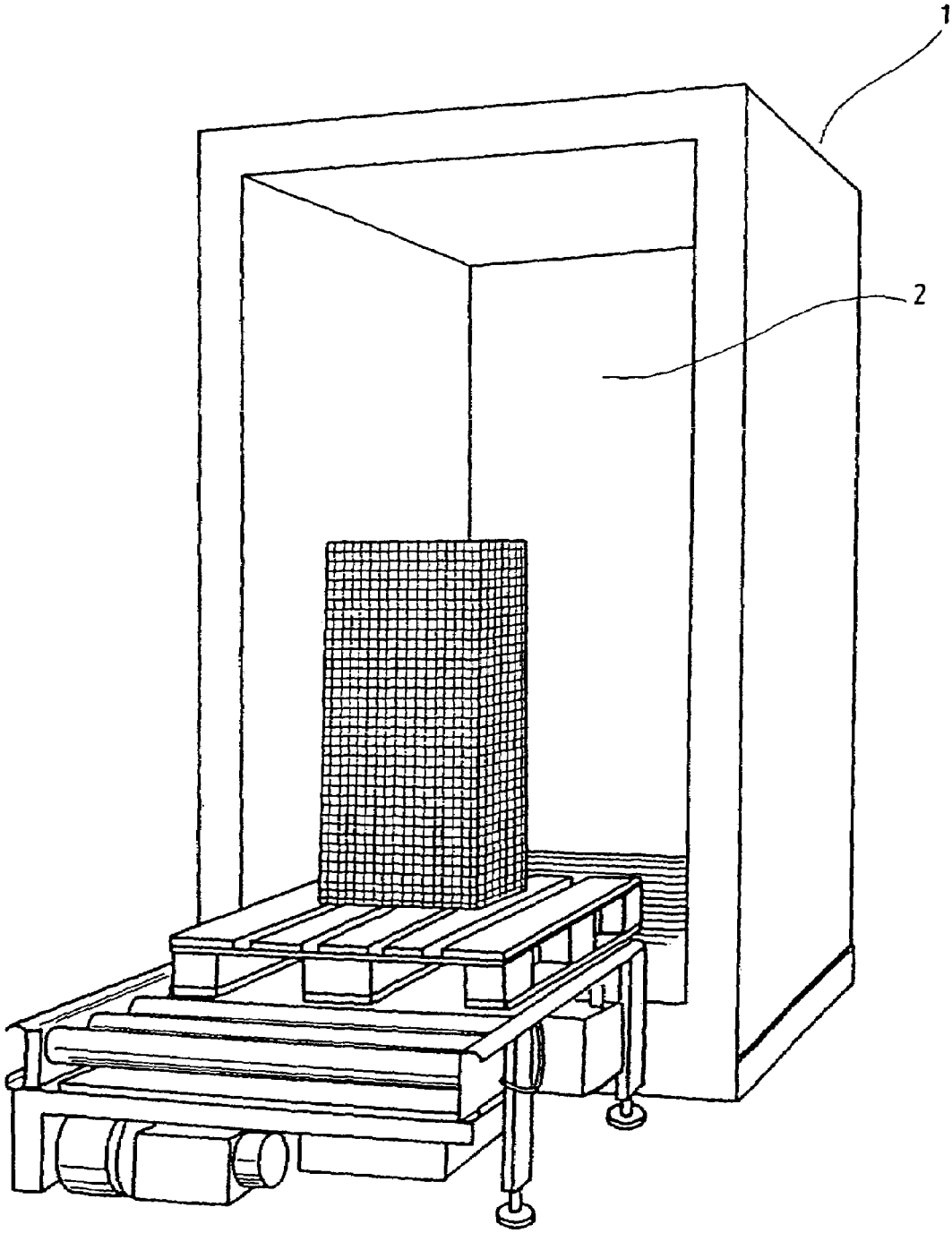
FIGS. 1 and 1*a* show a large-scale activator with tunnel-like activation zone.
Figure 1A:
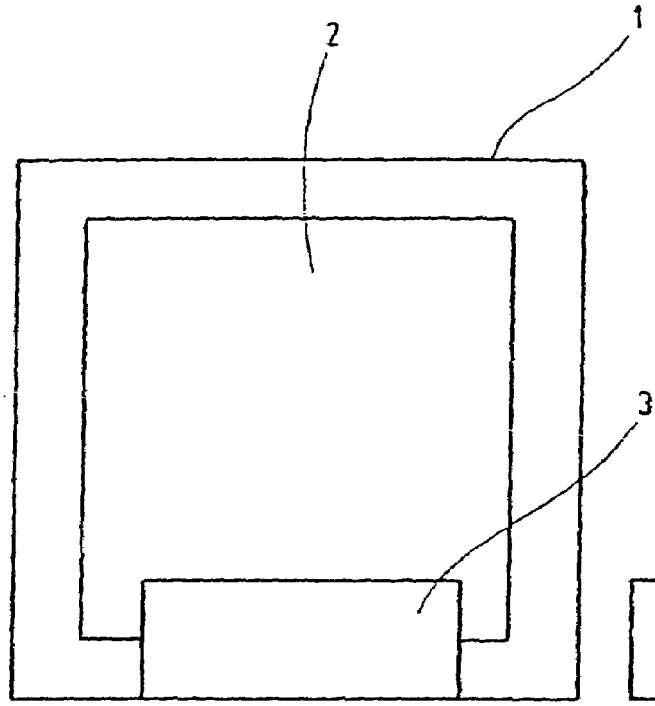

FIGS. 1 and 1*a* shows a large-scale activator 1 with a tunnel-shaped activation zone 2. At the base (floor) of the activation zone there is a transport mechanism which, for example, can carry a palette which is pushed through the activation zone 2.

Figure 1B:
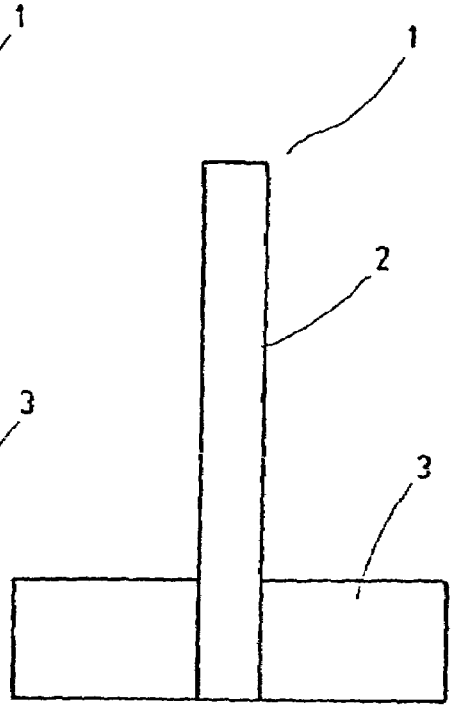
FIG. 1*b* shows a side view of the above-given large-scale activator.

FIG. 1*b* shows the same large-scale activator 1 from the side.

Figure 1C:
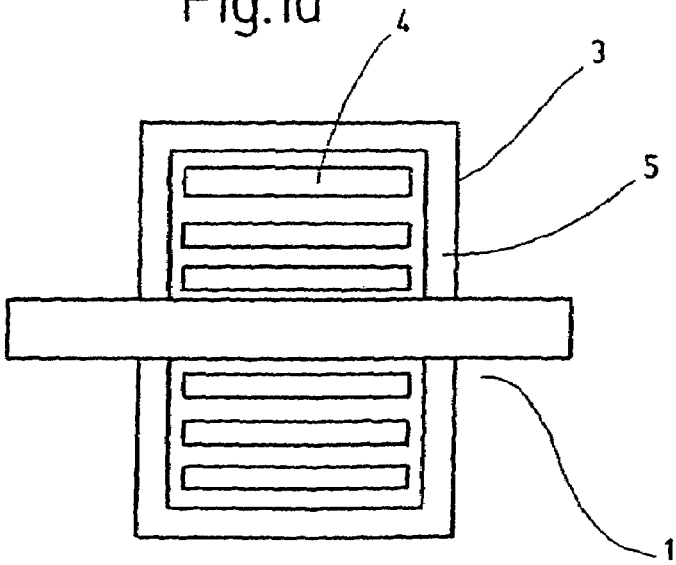
FIG. 1*c* shows a plan view of the above-given large-scale activator.

FIG. 1*c* shows such a large-scale activator 1 from above. The transport mechanism 3 of this large-scale activator includes rollers 4 on which palettes can be moved. The transport mechanism here is encompassed by a frame 5.

Figure 2:
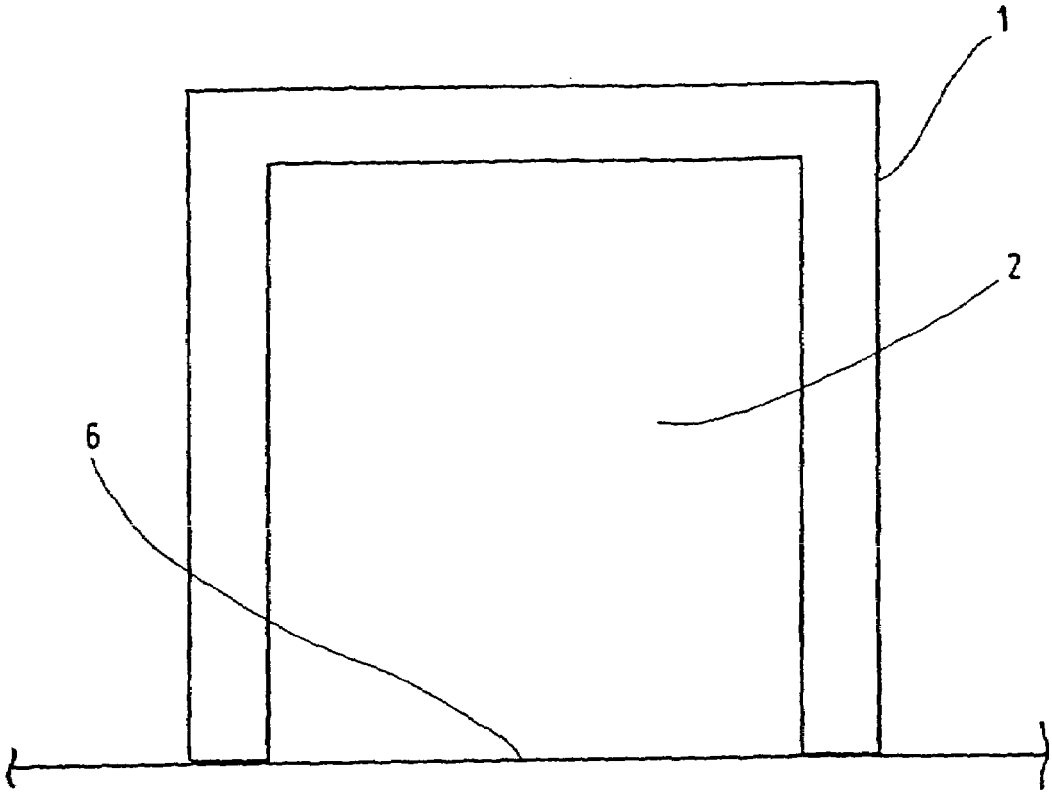
FIG. 2 shows a view of a large-scale activator with an activation zone at ground level.

FIG. 2 shows a large-scale activator 1, with the base (floor) of the activation zone 6 extending at ground level. Larger quantities of security elements can be pushed through such a large-scale activator, for instance on lift trucks.

Figure 3:
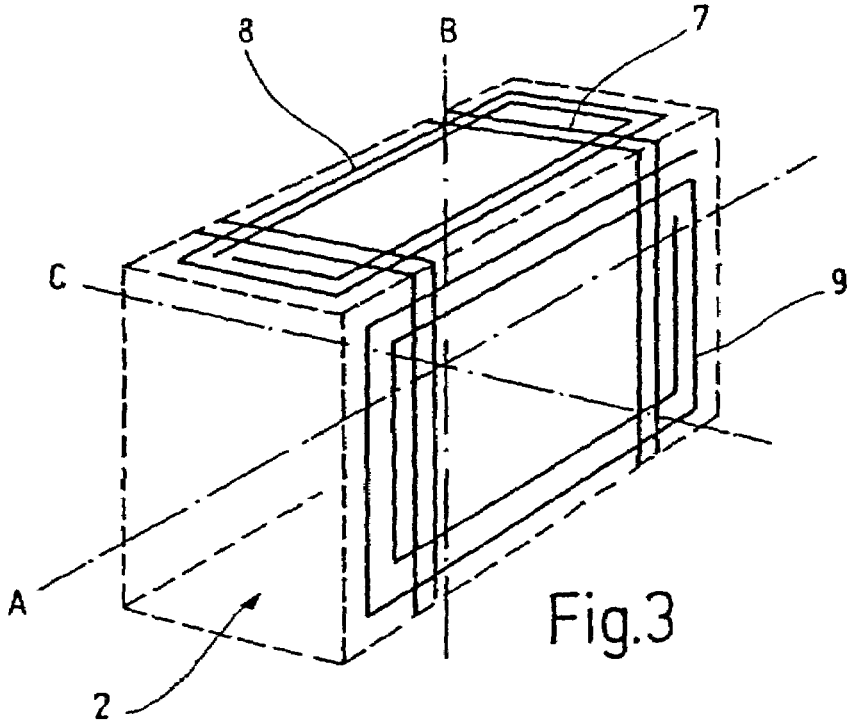
FIG. 3 shows a sketch of a coil arrangement necessary to produce a three-dimensional magnetic field.

FIG. 3 shows one example of a coil arrangement as required to produce a three-dimensional magnetic field. In this example, a coil system 7 produces a magnetic field that is oriented along axis A within the activation zone 2. A coil system 8 produces a magnetic field along axis B within the activation zone 2, while coil system 3 produces a magnetic field there along axis C. In this embodiment it serves the purpose to provide the activation zone 2 as a passageway or tunnel and to pass the security elements through it. Thus, in this embodiment three magnetic fields perpendicular to one another can be produced in the activation zone 2. In this case, the components of the magnetic fields there form a Cartesian coordinate system.

Figure 4:
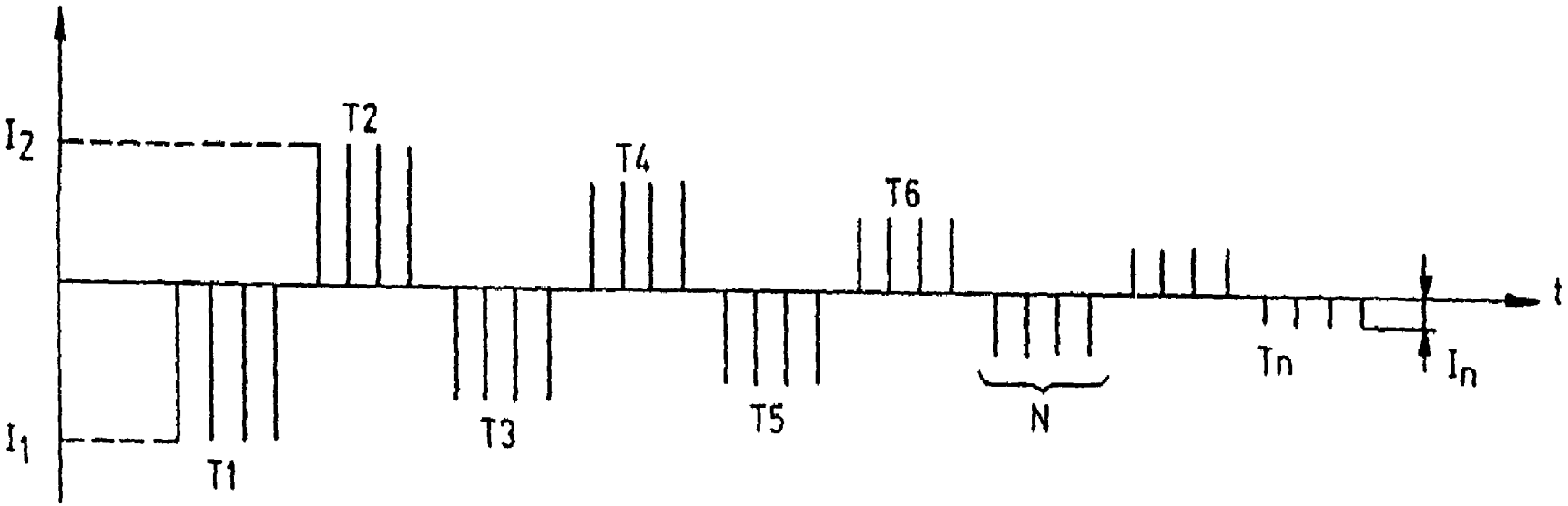
FIG. 4 shows a current pulse characteristic.

FIG. 4 shows an example of the characteristic of the current pulses. The individually successive current pulses in this embodiment form pulse groups $T_n$ up until the next change of polarity. The number of pulses per pulse group N, the duration of the pulses, and the interval of their succession are variable.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A large-scale activator for the activation of large quantities of security elements for electronic article protection, the activator comprising:

(a) a casing;

(b) a plurality of coils arranged in the casing which define an activation zone; and (c) a current supply circuit which triggers the coils with current pulses, wherein the amplitude of the current pulses diminishes as a function of time, and the coils produce magnetic fields in the activation zone that are perpendicular to one another, and wherein several successive ones of the current pulses have the same polarity, before a change of polarity of the current pulses occurs.

2. A large-scale activator for the activation of large quantities of security elements for electronic article protection, the activator comprising:

(a) a casing;

(b) a plurality of coils arranged in the casing which define an activation zone; and (c) a current supply circuit which triggers the coils with current pulses, wherein the amplitude of the current pulses diminishes as a function of time, and wherein several successive ones of the current pulses have the same polarity, before a change of polarity of the current pulses occurs.

3. A large-scale activator for the activation of large quantities of security elements for electronic article protection, the activator comprising:

(a) a casing;

(b) a plurality of coils arranged in the casting which define an activation zone; and (c) a current supply circuit which triggers the coils with current pulses; and (d) means for automatically recognizing whether the security elements have to be activated or deactivated, and wherein several successive ones of the current pulses have the same polarity, before a change of polarity of the current pulses occurs.

* * * * *